US008932515B2

(12) United States Patent
Beaulieu

(10) Patent No.: US 8,932,515 B2
(45) Date of Patent: Jan. 13, 2015

(54) CRUST BREAKER ALUMINUM BATH DETECTION SYSTEM

(75) Inventor: Gilles Beaulieu, Trois-Rivieres (CA)

(73) Assignee: La-Z-Boy Incorporated, Monroe, MI (US)

( * ) Notice: Subject to any disclaimer, the term of this patent is extended or adjusted under 35 U.S.C. 154(b) by 264 days.

(21) Appl. No.: 13/158,933

(22) Filed: Jun. 13, 2011

(65) Prior Publication Data

US 2012/0313298 A1 Dec. 13, 2012

(51) Int. Cl.

| | |
|---|---|
| ***B22D 41/00*** | (2006.01) |
| ***C22B 9/00*** | (2006.01) |
| ***B22D 45/00*** | (2006.01) |
| ***B22D 46/00*** | (2006.01) |

(52) U.S. Cl.

CPC ..... *B22D 45/00* (2013.01); *B22D 46/00* (2013.01)

USPC ..... 266/90; 266/44; 266/287; 92/85 R; 92/168

(58) Field of Classification Search

CPC ..... C25C 3/14; H01H 35/38; F15B 15/223; B22D 45/00; B22D 46/00

USPC ..... 266/44, 287, 90, 78; 204/228.1, 228.2, 204/228.5, 247; 205/230, 336; 91/27, 26, 91/32, 33, 217, 275, 346, 445, 471, 20, 91/169; 92/85 B, 168, 165 R, 162 R

See application file for complete search history.

(56) References Cited

U.S. PATENT DOCUMENTS

| | | | | |
|---|---|---|---|---|
| 2,881,403 A | * | 4/1959 | Vltavsky | 439/33 |
| 3,400,062 A | | 9/1968 | Bruno et al. | |
| 3,620,126 A | | 11/1971 | Fuhrimann | |
| 3,660,256 A | | 5/1972 | Lippitt et al. | |
| 3,664,946 A | * | 5/1972 | Schaper et al. | 204/245 |
| 4,680,930 A | | 7/1987 | Dollison | |

(Continued)

FOREIGN PATENT DOCUMENTS

| | | |
|---|---|---|
| CA | 2675697 A1 | 8/2008 |
| WO | WO2007-042780 | 4/2007 |

(Continued)

OTHER PUBLICATIONS

International Search Report for International Application No. PCT/US2012/042035 mailed Jan. 25, 2013.

(Continued)

*Primary Examiner* — Scott Kastler
*Assistant Examiner* — Michael Aboagye
(74) *Attorney, Agent, or Firm* — Harness, Dickey & Pierce, P.L.C.

(57) ABSTRACT

A crust breaker bath detection system includes a cylinder defining a piston chamber. A piston is slidably displaced within the piston chamber by a pressurized fluid. A crust breaker rod connected to the piston is displaced through a crust layer into a bath having a bath voltage when the piston is displaced in the cylinder in a piston drive direction. A controller is in electrical communication with the cylinder. A conductive member is retained by and in electrical contact with the piston and in continuous contact with the cylinder. The conductive member defines a portion of a bath detection circuit including the crust breaker rod, the piston, the conductive member, the cylinder and the controller. The bath detection circuit is closed when the crust breaker rod contacts the bath such that the bath voltage is communicated to the controller by the bath detection circuit.

28 Claims, 16 Drawing Sheets

(56) References Cited

U.S. PATENT DOCUMENTS

| | | | | |
|---|---|---|---|---|
| 4,700,612 | A * | 10/1987 | Pfister | 91/471 |
| 5,542,336 | A | 8/1996 | Larkin | |
| 5,944,045 | A | 8/1999 | Allen et al. | |
| 6,408,740 | B1 | 6/2002 | Holt et al. | |
| 6,436,270 | B1 | 8/2002 | Sander | |
| 6,776,081 | B2 | 8/2004 | Casinge et al. | |
| 7,429,314 | B2 * | 9/2008 | Couvreur et al. | 204/230.5 |
| 7,892,319 | B2 | 2/2011 | Massaro et al. | |
| 2002/0170819 | A1 * | 11/2002 | Horstmann et al. | 204/245 |
| 2007/0186763 | A1 | 8/2007 | Weiler, Jr. et al. | |
| 2009/0078110 | A1 | 3/2009 | Waldmann et al. | |
| 2009/0308721 | A1 | 12/2009 | Beaulieu | |
| 2012/0292834 | A1 | 11/2012 | Palsson | |

FOREIGN PATENT DOCUMENTS

| | | | |
|---|---|---|---|
| WO | WO 2007-042780 | | 4/2007 |
| WO | WO 2007042780 | * | 4/2007 |
| WO | WO2011-060876 | | 5/2011 |

OTHER PUBLICATIONS

Written Opinion of the International Searching Authority for International Application No. PCT/US2012/042035 mailed Jan. 25, 2013.

Verreault, J., et al., "Retrofit of a Combined Breaker Feeder with a Chisel Bath Contact Detection System to Reduce Anode Effect Frequency in a Potroom." in: Light Metals 2011 (Edited by: Stephen J. Lindsay) TMS (The Minerals, Metals & Materials Society), 2011, pp. 467-470.

International Search Report for PCT/US2012/042016 mailed Feb. 26, 2013.

Written Opinion of the International Searching Authority for PCT/US2012/042016 mailed Feb. 26, 2013.

* cited by examiner

CRUST BREAKER ALUMINUM BATH DETECTION SYSTEM

FIELD

The present disclosure relates to control systems for detecting aluminum processing baths.

BACKGROUND

This section provides background information related to the present disclosure which is not necessarily prior art.

Known systems used to control operations of aluminum processing baths can include electrical circuits closed when a crust breaking tool creates an aperture by breaking through the hardened upper crust formed on the bath and either encounters a layer of alumina, or the molten layer of aluminum below the layer of alumina. The aperture formed through the crust is necessary to permit feeding new alumina material into the bath. When the electrical circuit closes, a signal is created which directs the crust breaking tool to retract from the crust layer. An example of such a system is disclosed in U.S. Pat. No. 6,649,035 to Horstmann et al. A drawback of such systems occurs when crust material forms on the crust breaking tool or corrosive effects of the bath prevent completion of the electrical circuit.

In this situation, the crust breaking tool can remain in the bath for an undesirable length of time which can damage the crust breaking tool, or render the detection system inoperative. In these situations, the subsequent feeding of new alumina material into the bath can be hindered, or the system may be unable to identify how many feed events have occurred, thus leading to out-of-range conditions in the bath. A further drawback of known control systems is the crust breaking tool is generally driven by a system using high pressure air. The longer the crust breaking tool is suspended or extended into the bath, the greater volume of high pressure air is required, which significantly increases operating costs of the system due to the size and volume of high pressure air system requirements, which increases the number of air compressors and air dryers required for operation.

SUMMARY

This section provides a general summary of the disclosure, and is not a comprehensive disclosure of its full scope or all of its features.

According to several embodiments, a bath detection system includes a cylinder defining a piston chamber. A piston is slidably displaced within the cylinder by a pressurized fluid directed to either a first portion of the piston chamber with respect to the piston or a second portion of the piston chamber oppositely positioned about the piston with respect to the first portion. A piston rod, which can include a tool or chisel head is connected to the piston and displaced into a bath when the piston is displaced in the cylinder in a piston drive direction. A conductive member in electrical contact with the piston is in slidable contact with the cylinder. The conductive member defines a portion of a bath detection circuit including the piston rod, the piston, the conductive member and the cylinder. The bath detection circuit is closed when the piston rod contacts the bath.

According to other embodiments, a crust breaker bath detection system includes a cylinder defining a piston chamber. A piston is slidably displaced within the piston chamber by a pressurized fluid. A crust breaker, which can include a tool or chisel head is connected to the piston and displaced through a crust layer into a bath having a bath voltage when the piston is displaced in the cylinder in a piston drive direction. A controller is in electrical communication with the cylinder. A conductive member is retained by and in electrical contact with the piston and in continuous contact with the cylinder. The conductive member defines a portion of a bath detection circuit including the crust breaker rod, the piston, the conductive member, the cylinder and the controller. The bath detection circuit is closed when the crust breaker rod contacts the bath such that the bath voltage is communicated to the controller by the bath detection circuit.

According to additional embodiments, a crust breaker aluminum bath detection system includes a conductive cylinder defining a piston chamber. A conductive piston is slidably displaced within the cylinder by a pressurized fluid directed to either a first portion of the piston chamber with respect to the piston or a second portion of the piston chamber oppositely positioned about the piston with respect to the first portion. Means for crust breaking is connected to the piston and displaced into an aluminum melt bath when the piston is displaced in the cylinder in a piston drive direction. Means for conducting a voltage is retained by and in conductive contact with the piston and in slidable and conductive contact with the cylinder.

According to further embodiments, a method is provided for controlling a crust breaker aluminum bath detection system. The system has a cylinder, a piston slidably displaced within the cylinder, a piston rod connected to the piston, a controller in electrical communication with the cylinder, and a conductive member retained by and in electrical contact with the piston and in slidable contact with the cylinder. The method includes: creating a bath detection circuit including the piston rod, the piston, the conductive wear band, the cylinder and the controller such that a bath voltage of the aluminum melt bath is transferred to the controller by the bath detection circuit; aligning a source having a pressurized fluid with the cylinder; and displacing the piston rod in a piston drive direction using the pressurized fluid.

According to still other embodiments, a piston and cylinder electrical system includes a conductive cylinder defining a piston chamber. A conductive piston is slidably displaced within the piston chamber by a pressurized fluid directed to either a first portion of the piston chamber with respect to the piston or a second portion of the piston chamber oppositely positioned about the piston with respect to the first portion. A conductive member is retained by and in electrical contact with the piston and in slidable and electrical contact with the cylinder. The conductive member defines a portion of a circuit including the piston, the conductive member and the cylinder.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings. For simplification, not all parts are shown in all views of the drawings.

DETAILED DESCRIPTION

Example embodiments will now be described more fully with reference to the accompanying drawings.

Figure 1:
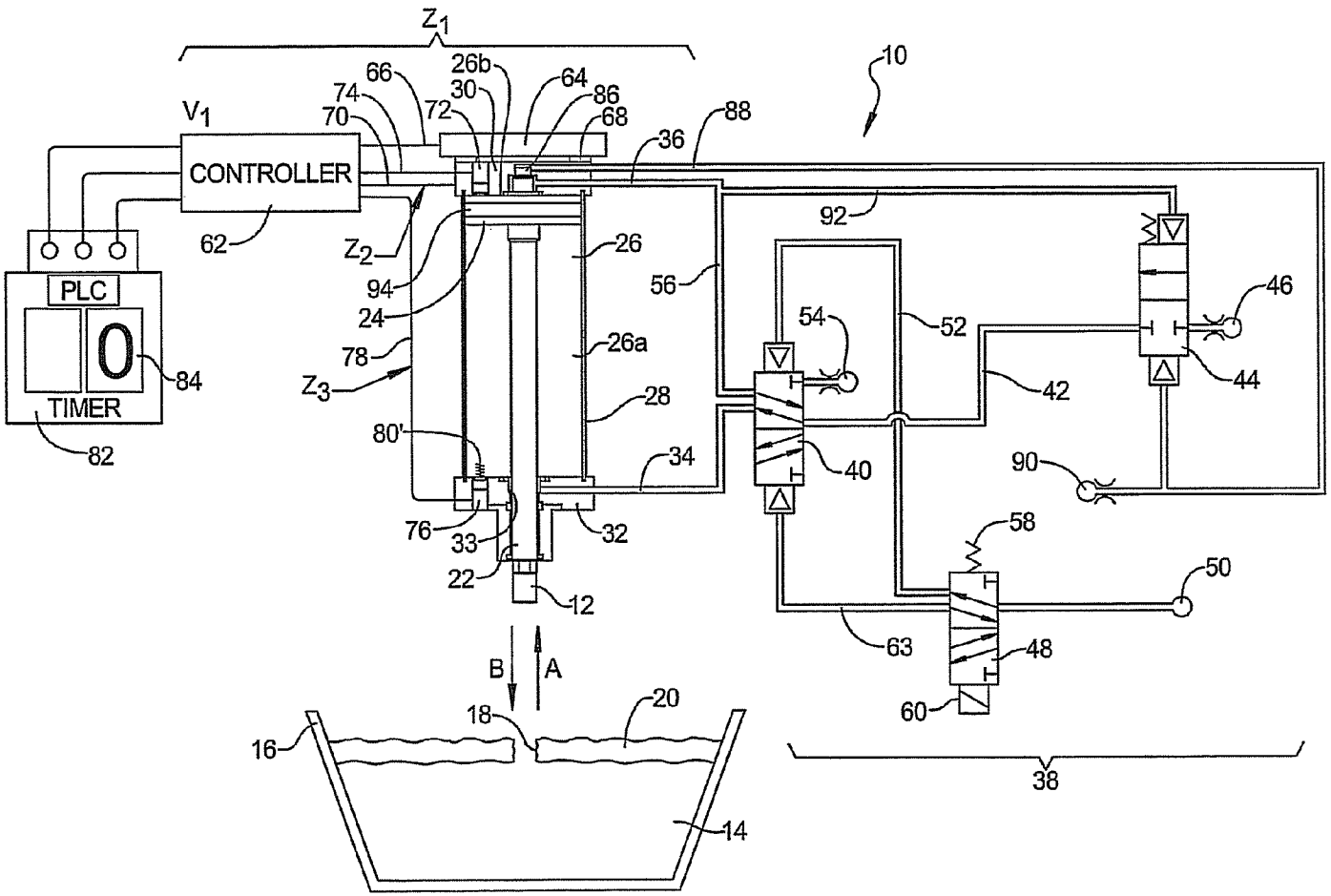
FIG. 1 is a diagram for a bath detection system of the present disclosure prior to initiation of a crust breaking and bath detection operation.

Referring to FIG. 1, a bath detection system 10 used for example for production of aluminum includes a crust breaker rod 12 which is axially extended into a melt bath 14 in a bath chamber. Crust breaker rod 12 is used at a bath chamber 16 to pierce an aperture 18 through a crust layer 20 which forms at the surface of the melt bath 14. Crust breaker rod 12 is connected to a first end of a piston rod 22 which has a piston 24 connected at an opposite second end. According to other embodiments, crust breaker rod 12, which can include a crust breaking tool or chisel head, is an integral portion of piston rod 22, therefore piston rod 22 directly contacts melt bath 14. Piston 24 is slidably disposed in a piston chamber 26 of a cylinder 28 allowing piston 24 to slide in either of a piston return direction "A" or a piston drive direction "B". As piston 24 moves in either of the piston return direction "A" or the piston drive direction "B", the total travel path of piston 24 is limited by piston contact with either a first cylinder head 30 or an opposite second cylinder head 32. Second cylinder head 32 includes a bearing/seal 33 creating a pressure containing boundary for piston rod 22 and piston chamber 28.

At a top or piston first stop position shown, piston 24 is held in position by pressurized air in piston chamber 26 which is provided through a connection at cylinder 28 via a first air supply/vent line 34 beneath piston 24, creating a force directing piston 24 in the piston return direction "A". At this position of piston 24, a second air supply/vent line 36, which is directed through first cylinder head 30 into piston chamber 26 above piston 24, is vented to atmosphere. Pressurized fluid such as air is supplied to either first or second air supply/vent lines 34, 36 by a pneumatic control system 38. Pneumatic control system 38 includes a pneumatically positioned first control valve 40 which in the piston first stop position is aligned with a first air pressure line 42. At the piston first stop position, pressurized air is trapped in a path including a first portion 26*a* of piston chamber 26 defined as the partial volume of piston chamber below piston 24, first air supply/vent line 34, first control valve 40, and first air pressure line 42. Second control valve 44 is positioned to isolate first air pressure line 42 from a first pressure source 46. Approximately 8 psi air pressure is trapped in first air supply/vent line 34 and below piston 24 in first portion 26*a*. The trapped air path minimizes the air volume required to hold piston 24 in the piston first stop position.

First control valve 40 can be repositioned using air pressure delivered to opposite valve member ends of first control valve 40 by repositioning a biased solenoid operated valve 48. In the piston first stop position, pressurized air from a second pressure source 50 is delivered through a flow path of a first valve positioning line 52 to position first control valve 40 to align first air pressure line 42 with first air supply/vent line 34 and to isolate the flow path from a third pressure source 54 to an air delivery/vent line 56 which is connected to second air supply/vent line 36. Solenoid operated valve 48 is normally biased to the position shown by a biasing member 58 such as a compression spring. The biasing force of biasing member 58 can be overcome to reposition solenoid operated valve 48 by energizing a solenoid 60 of solenoid operated valve 48 using a current delivered from a power source controlled by signals using a control device such as a computer, a printed logic circuit, and/or a controller or similar device, hereinafter collectively referred to as controller 62. When solenoid operated valve 48 is repositioned by operation of solenoid 60, air pressure from second pressure source 50 is delivered through a second valve positioning line 63 to first control valve 40 while first valve positioning line 52 is vented to atmosphere through solenoid operated valve 48, which will be shown and described in reference to FIG. 2.

A conductive base member 64 which can have an anode positive electrical potential is electrically connected to controller 62 using a first voltage line 66. Base member 64 is electrically isolated from first cylinder head 30 using insulated connectors 68. First cylinder head 30 which can have a cathode negative electrical potential is electrically connected to controller 62 using a second voltage line 70.

When piston 24 is at a piston first contact position in contact with or proximate to first cylinder head 30, a first voltage circuit $Z_1$ is closed. First voltage circuit $Z_1$ is connected to a source voltage $V_1$ and an electrical load for example through controller 62 through a path including second voltage line 70, first cylinder head 30, cylinder 28, a piston member, a wear band, and/or a seal, hereinafter collectively defined as conductive piston seal 94, piston 24, a first electrical contact device 72 mounted to but electrically isolated from first cylinder head 30, and a first signal line 74 connecting first electrical contact device 72 to controller 62. When piston 24 contacts first electrical contact device 72 first voltage circuit $Z_1$ closes. First voltage circuit $Z_1$ when identified by controller 62 generates a confirmation signal in controller 62 that piston 24 is at the piston first stop position.

First voltage circuit $Z_1$ opens when piston 24 displaces away from contact with first electrical contact device 72. A second electrical circuit $Z_2$ is then closed when crust breaker rod 12 contacts melt bath 14 and a predetermined voltage of melt bath 14 is detected in controller 62, which will be described in greater detail in reference to FIG. 4.

A second electrical contact device 76, which is similar to first electrical contact device 72, is connected to but electrically isolated from second cylinder head 32. Second electrical contact device 76 is provided to close a third voltage circuit $Z_3$ generating a confirmation signal that piston 24 is proximate to or in contact with second cylinder head 32, defining a piston second stop position (shown in reference to FIG. 7). Contact of piston 24 with second electrical contact device 76 closes third voltage circuit $Z_3$. Third voltage circuit $Z_3$ can also be connected to source voltage $V_1$ and the electrical load for example through controller 62. Third voltage circuit $Z_3$ includes a path having second voltage line 70, first cylinder head 30, cylinder 28, conductive seal 94, piston 24, second electrical contact device 76, and a second signal line 78 connecting second electrical contact device 76 to controller 62. Each of the first and second electrical contact devices 72, 76 include a conductive contact device biasing member 80, 80' (only conductive biasing member 80' is visible in this view) such as a compression spring, which each extend into piston chamber 26 and elastically deflect when directly contacted by piston 24.

Bath detection system 10 also includes a timer 82 which can be pre-set to a time period during which crust breaker rod 12 is displaced from the position shown, either extends through aperture 18 or contacts and breaks through crust layer 20 creating aperture 18, extends partially into melt bath 14, and returns to the piston first stop position. An exemplary time period for completing this operation cycle can be approximately four (4) seconds, although other time periods and portions thereof may also be used. A visual indicator symbol 84 of the time period remaining during an operation cycle can be provided with timer 82. According to several embodiments, timer 82 is electrically controlled by controller 62. Timer 82 and controller 62 can be provided together in a common unit, or spatially separated.

A spud or rod extending portion 86 of piston rod 22 is received in a cavity of first cylinder head 30 at the piston first stop position. Rod extending portion 86 is exposed to pressurized air from a fourth pressure source 90 via a pressure transfer line 88. The engaged position of rod extending portion 86 with first cylinder head 30 isolates the pressurized air in a pressure transfer line 88 from a valve position control line 92 leading to one end of second control valve 44. In the engaged position of rod extending portion 86 valve position control line 92 is vented to atmosphere via a path including air delivery/vent line 56. The air pressure from fourth pressure source 90 therefore acts to hold the position shown for second control valve 44. A force of the pressurized air trapped in first portion 26*a* of piston chamber 26 acts over the surface area of piston 24. This force per unit area is greater than an oppositely directed force per unit area exerted on rod extending portion 86 from fourth pressure source 90 thereby retaining the piston first stop position.

In order to close first or third electrical circuits $Z_1$ or $Z_3$, and to transfer an electrical signal indicating when crust breaker rod 12 contacts melt bath 14, conductive piston seal 94 is provided at an outer perimeter of piston 24. If in the form of a wear band or seal, conductive piston seal 94 is positioned in a slot or ring created in the outer perimeter wall of piston 24. A second function of piston seal 94 is to provide a pressure containment boundary or seal between piston 24 and an inner wall of cylinder 28 to isolate first portion 26*a* from a second portion 26*b* of piston chamber 26.

Figure 2:
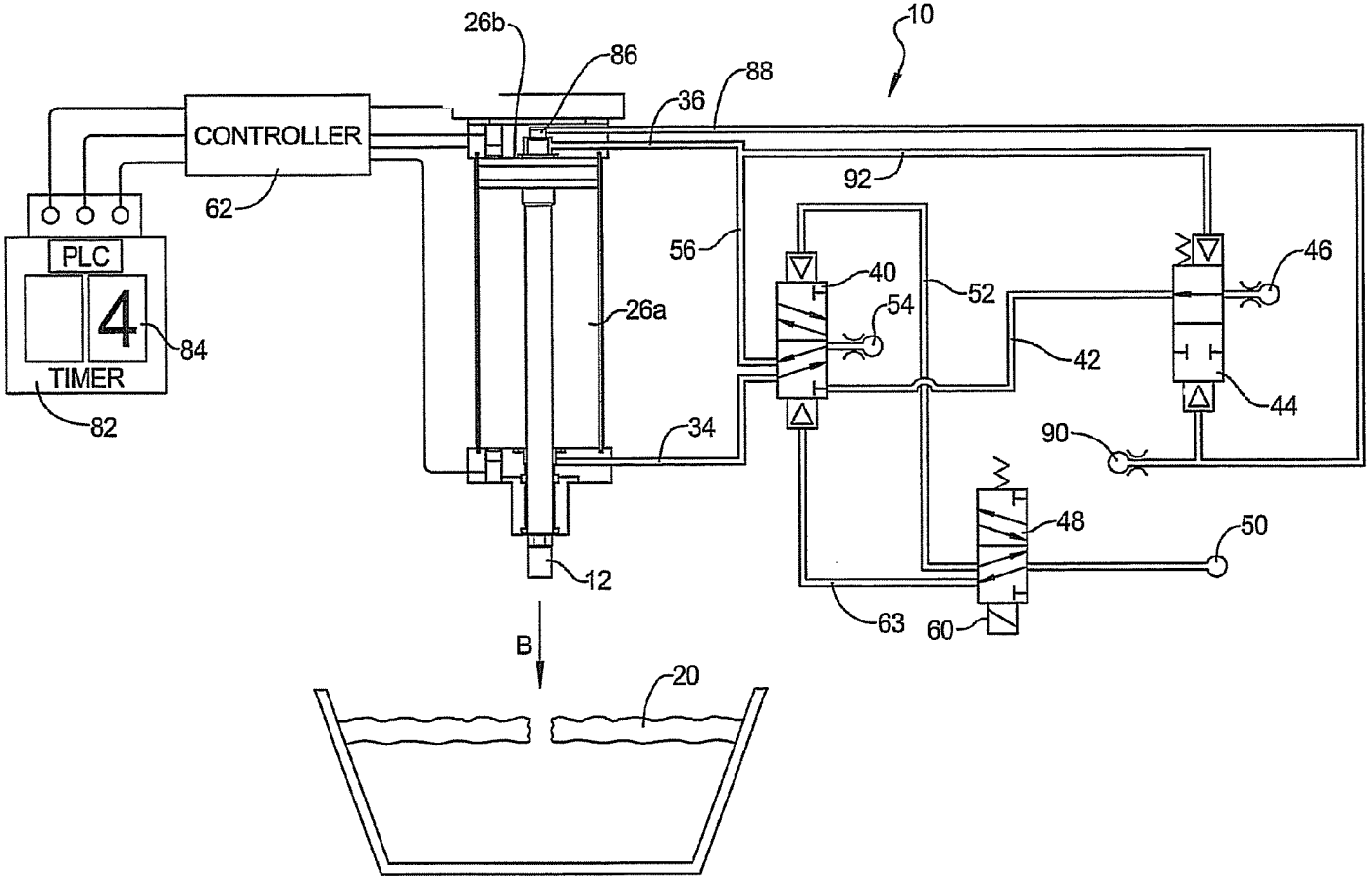
FIG. 2 is a diagram modified from FIG. 1 to show the bath detection system upon initializing a crust breaking and bath detection operation.

Referring to FIG. 2, to initiate displacement of crust breaker rod 12 toward crust layer 20, controller 62 sets timer 82 to approximately 4 seconds, indicated at indicator symbol 84, and simultaneously energizes solenoid 60 to reposition the internal valve member of solenoid operated valve 48 as shown, thereby redirecting pressurized air from second pressure source 50 via second valve positioning line 63 to displace the valve member of first control valve 40. After the repositioning of first control valve 40 pressurized air from third pressure source 54 is directed into air delivery/vent line 56 and into second air supply/vent line 36 to pressurize second portion 26*b* of piston chamber 26. First air supply/vent line 34 is simultaneously aligned to vent to atmosphere through first control valve 40, thereby venting first portion 26*a* of piston chamber 26 to zero (0) psi. Increasing pressure in second portion 26*b* will begin to displace piston 24 in the piston drive direction "B".

Pressurized air from fourth pressure source 90 which normally acts on rod extending portion 86 via pressure transfer line 88 now assists in displacing piston 24. Pressurized air in air delivery/vent line 56 pressurizes valve position control line 92 which repositions second control valve 44. When second control valve 44 is repositioned as shown, first air pressure line 42 is pressurized from first pressure source 46.

Figure 3:
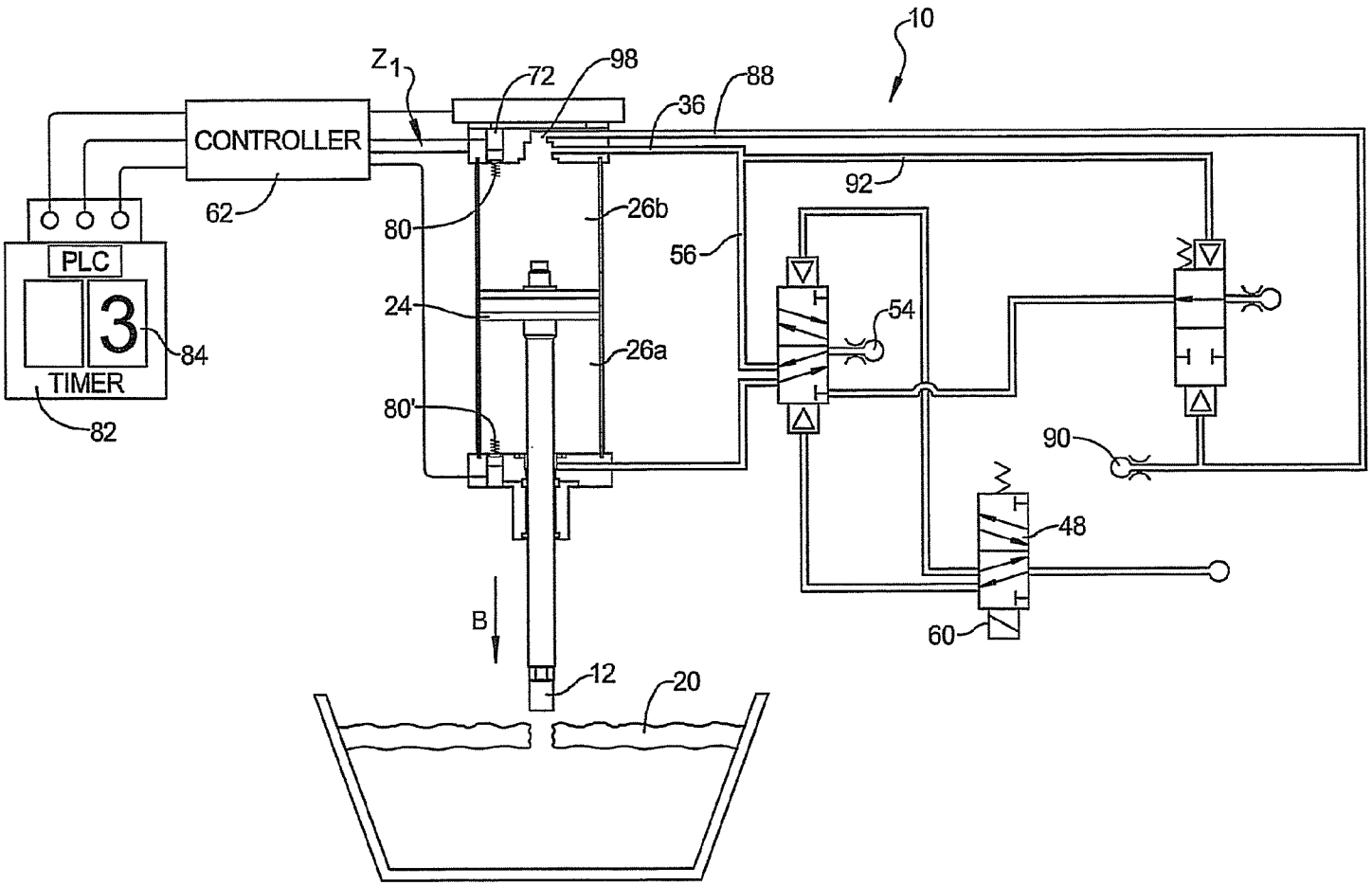
FIG. 3 is a diagram modified from FIG. 2 to show the crust breaker rod prior to encountering a crust layer.

Referring to FIG. 3, continued flow of pressurized air from third pressure source 54 via second air supply/vent line 36 and from fourth pressure source 90 via pressure transfer line 88 displaces piston 24 in the piston drive direction "B" toward crust layer 20. Controller 62 continues to direct current flow to solenoid 60 of solenoid operated valve 48 to maintain the energized state of solenoid 60. Indicator symbol 84 displays the numeral 3, indicating that approximately one second has elapsed from the start of the crust breaker operation cycle and 3 seconds remain of the cycle. When piston 24 moves away from contact with contact device biasing member 80 of first electrical contact device 72, first circuit $Z_1$ opens, identifying piston 24 is no longer at the piston first contact position.

Referring to FIG. 4 and again to FIG. 1, bath detection system 10 indicates detection of melt bath 14 after crust breaker rod 12 either creates aperture 18 or extends through an existing aperture 18 in crust layer 20, and subsequently enters melt bath 14. Crust layer 20 is normally substantially non-conductive, therefore contact by crust breaker rod 12 with crust layer 20 does not generate a bath detection signal. Melt bath 14 generates a small cathode bath voltage $V_2$ (as one example, approximately 0.1 to 4.0 VDC; or −0.1 to −4.0 VDC, depending on how the voltage is measured) which can vary with a depth of melt bath 14. The bath detection or second electrical circuit $Z_2$ is closed when crust breaker rod 12 enters melt bath 14. Bath detection second electrical circuit $Z_2$ includes anode voltage provided from base member 64 carried via first voltage line 66 to controller 62, and the cathode bath voltage $V_2$ of melt bath 14 which is conducted by crust breaker rod 12 through piston rod 22, piston 24, piston seal 94, cylinder 28, first cylinder head 30 and second voltage line 70 to controller 62. When the measured bath voltage $V_2$ is a predetermined amount (approximately 0.30 VDC or −0.30 VDC) at controller 62, a voltage $V_3$ is created and used by controller 62 to signal solenoid 60 of solenoid operated valve 48 to de-energize.

Figure 4:
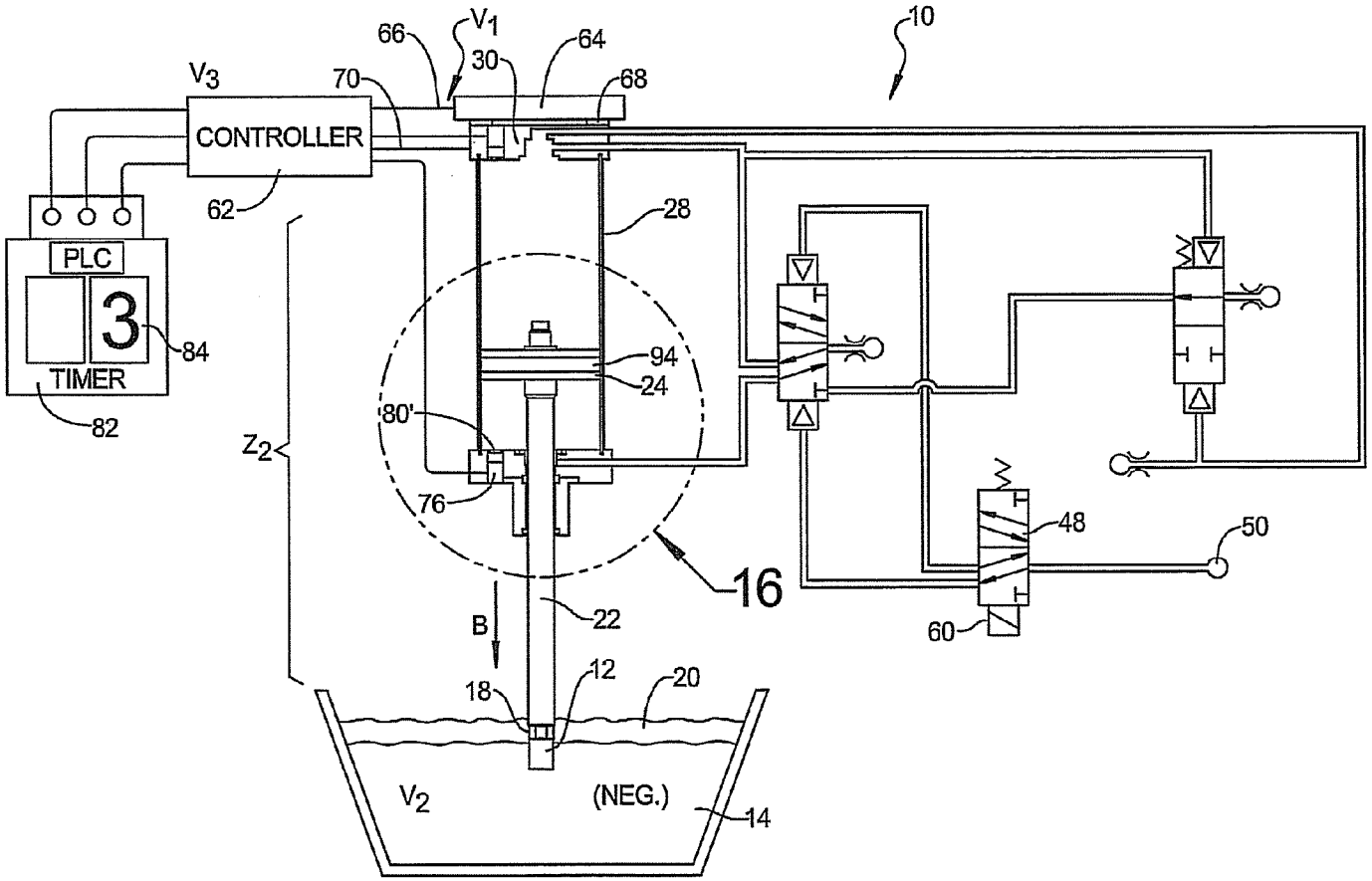
FIG. 4 is a diagram modified from FIG. 3 to show a bath detection position of the crust breaker rod.
Figure 5:
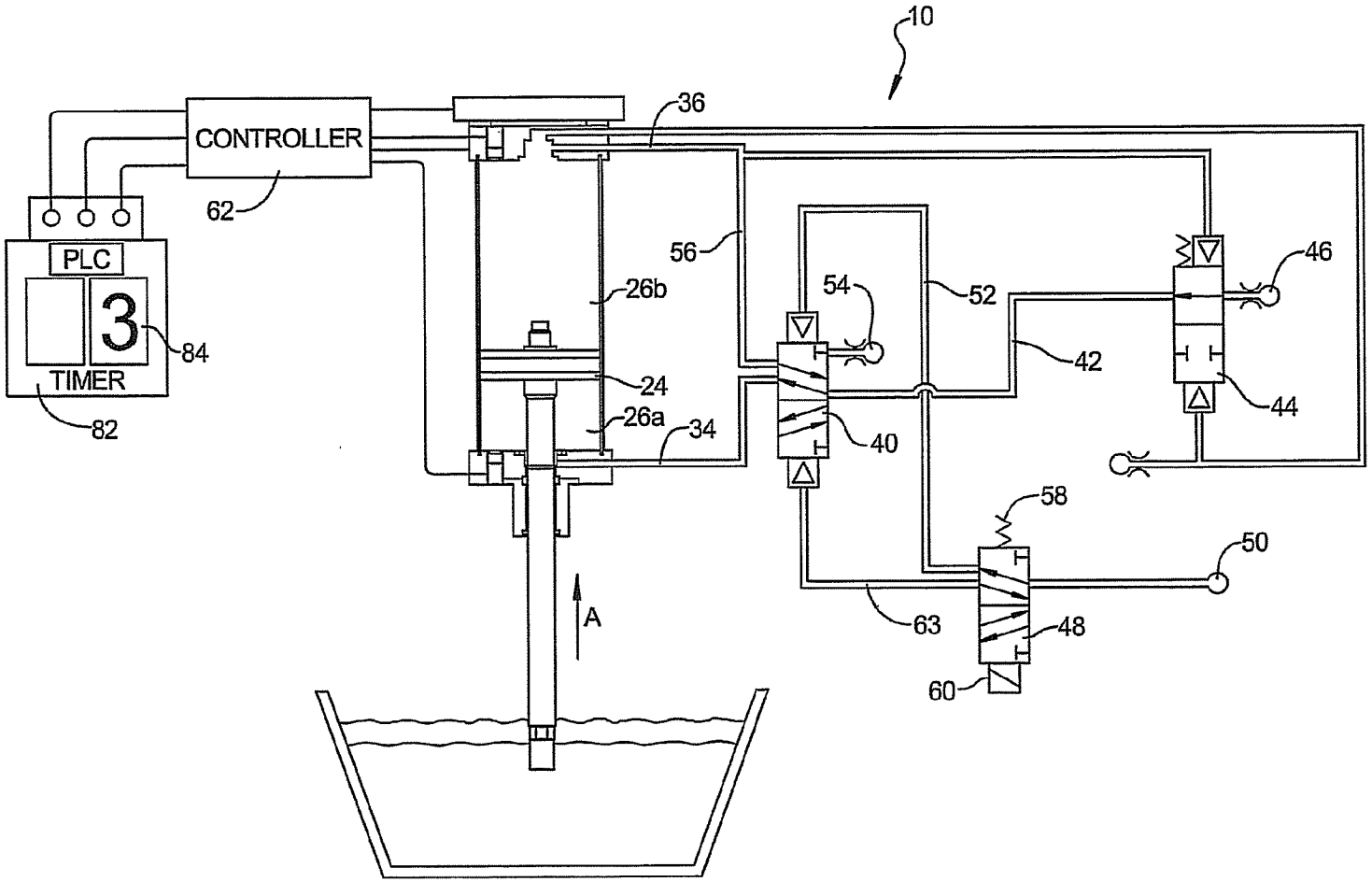
FIG. 5 is a diagram modified from FIG. 4 to show realignment of system control valves following bath detection.

Referring to FIG. 5 and again to FIG. 4, immediately upon sensing melt bath 14, controller 62 directs solenoid 60 of solenoid operated valve 48 to de-energize. After shifting position, solenoid operated valve 48 directs pressurized air from second pressure source 50 to realign first control valve 40.

Because second control valve 44 was previously shifted into alignment with first pressure source 46, pressurized air from first pressure source 46 is directed via pressure line 42 and first air supply/vent line 34 into first portion 26*a* of piston chamber 26, while pressurized air in third pressure source 54 is isolated and pressurized air in second portion 26*b* is vented to atmosphere through second air supply/vent line 36, air delivery/vent line 56 and first control valve 40. Piston 24 then begins to move in the piston return direction "A".

Figure 6:
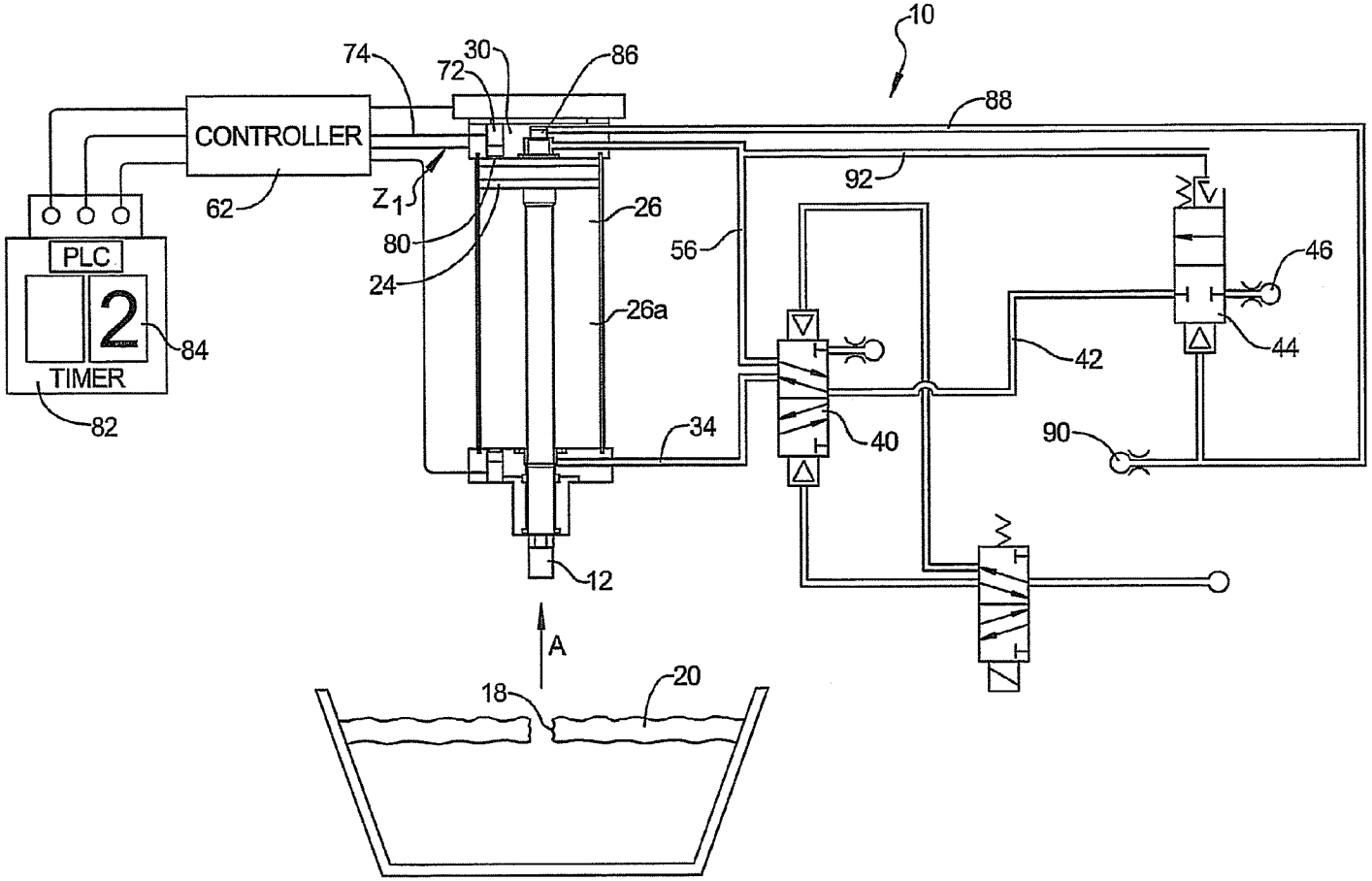
FIG. 6 is a diagram modified from FIG. 5 to show completion of the crust breaker and bath detection operation prior to completion of a predetermined time period.

Referring to FIG. 6, piston 24 returns to the piston first contact position with first cylinder head 30 contacting biasing member 80 of first electrical contact device 72, closing first circuit $Z_1$. At this time, and as previously noted, rod extending portion 86 enters a cavity in first cylinder head 30 thereby isolating pressure transfer line 88 from valve position control line 92 such that valve position control line 92 vents to atmosphere via air delivery/vent line 56 and first control valve 40. This event occurs with approximately 2 seconds remaining in the cycle, indicated by indicator symbol 84 in the countdown timer. The air pressure in the lines vented to atmosphere continues to reduce to zero psi, allowing pressurized air in fourth pressure source 90 to overcome the biasing force acting on second control valve 44 and reposition second control valve 44 such that first pressure source 46 is isolated from first air pressure line 42. Pressurized air in first portion 26*a* of piston chamber 26 is thereby trapped, which holds piston 24 in the piston first stop position.

Referring to FIG. 7 and again to FIGS. 1 and 4, if contact between crust breaker rod 12 and melt bath 14 does not close bath detection second circuit $Z_2$, air pressure in second portion 26*b* of piston chamber 26 continues to displace piston 24 in the piston drive direction "B" until piston 24 contacts biasing member 80' of second electrical contact device 76 and subsequently contacts second cylinder head 32, reaching the piston second stop position. A failure to detect the melt bath 14 can result from excess corrosion or a coating material 96 such as alumina or crust material covering crust breaker rod 12 from previous crust breaking operations, which is non-conductive, that prevents closure of bath detection second circuit $Z_2$. To minimize the volume of pressurized air entering second portion 26*b* from third pressure source 54, which may contain pressurized air up to approximately 100 psi, contact of biasing member 80 closes third circuit $Z_3$ which initiates return of piston 24 in the piston return direction "A".

Figure 7:
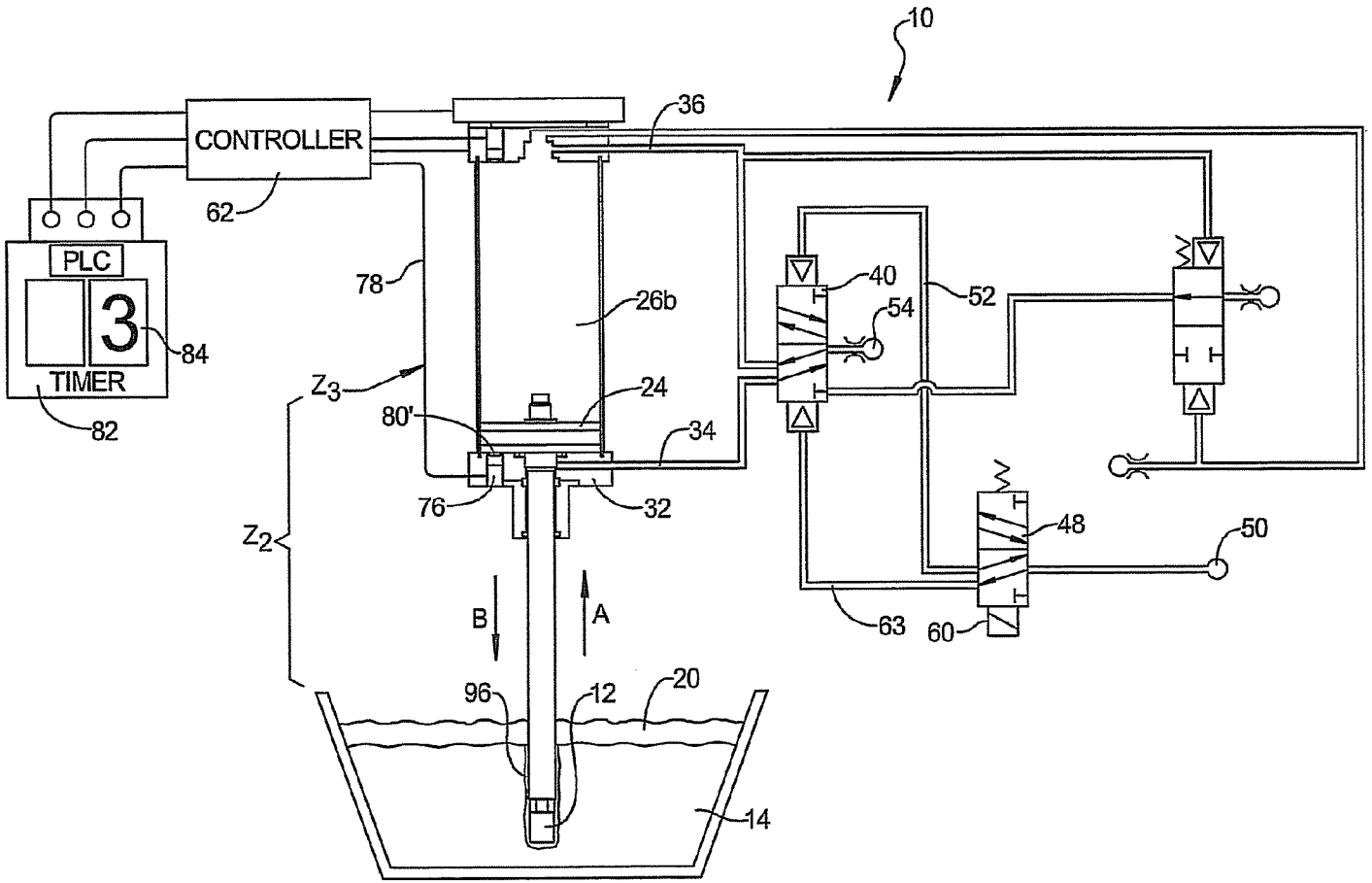
FIG. 7 is a diagram modified from FIG. 4 to show a no bath detection operating condition.
Figure 8:
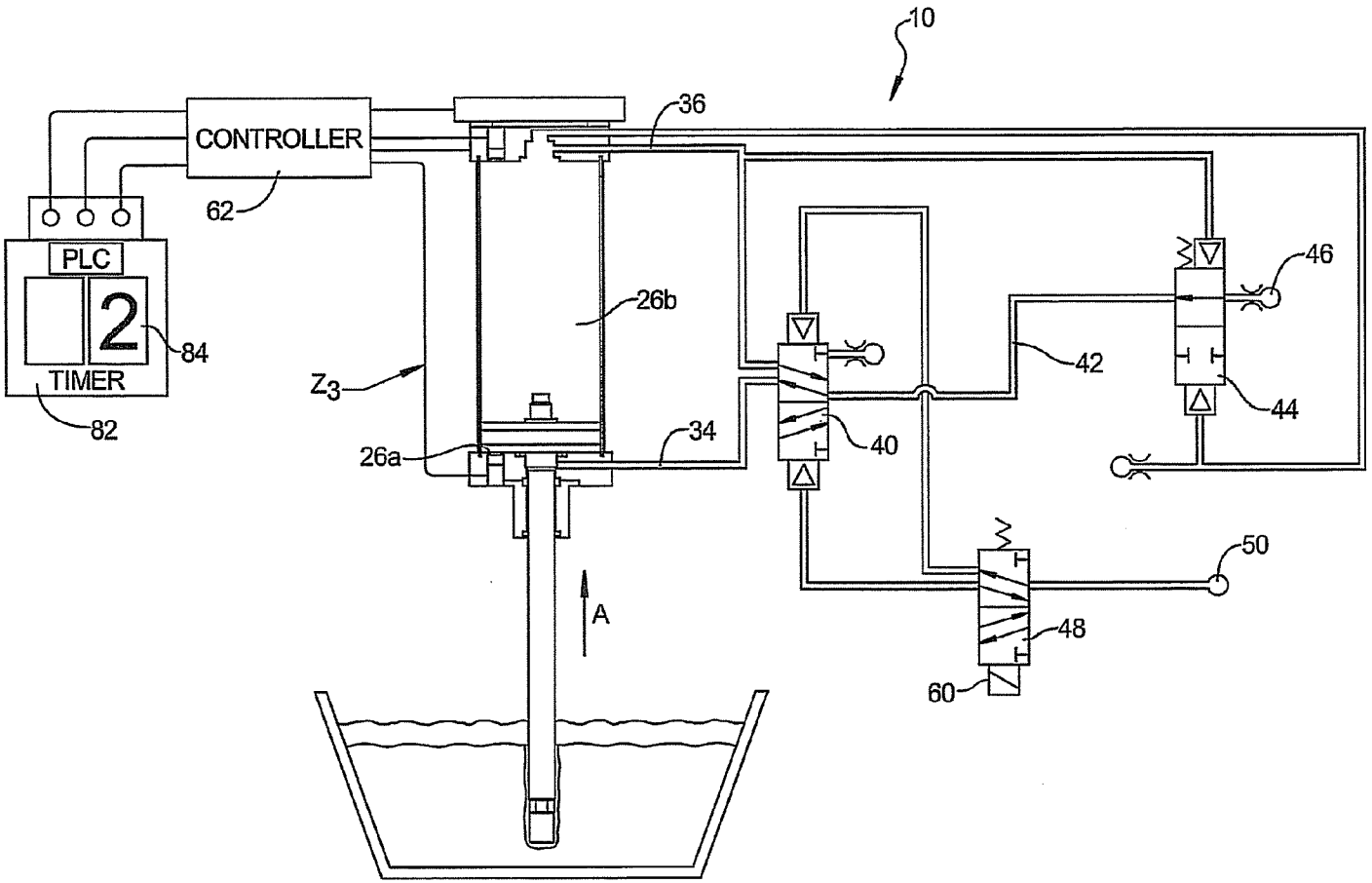
FIG. 8 is a diagram modified from FIG. 7 to show realignment of system control valves following the no bath detection condition.

Referring to FIG. 8 and again to FIG. 7, closure of third circuit $Z_3$ generates a signal from controller 62 directing solenoid 60 to de-energize. This repositions first control valve 40 and directs pressurized air from first pressure source 46 to first portion 26*a* of piston chamber 26 to displace piston 24 away from the piston second stop position in the piston return direction "A" as previously described herein. This event occurs with approximately 2 seconds indicated by indicator symbol 84 of the countdown timer 82.

Figure 9:
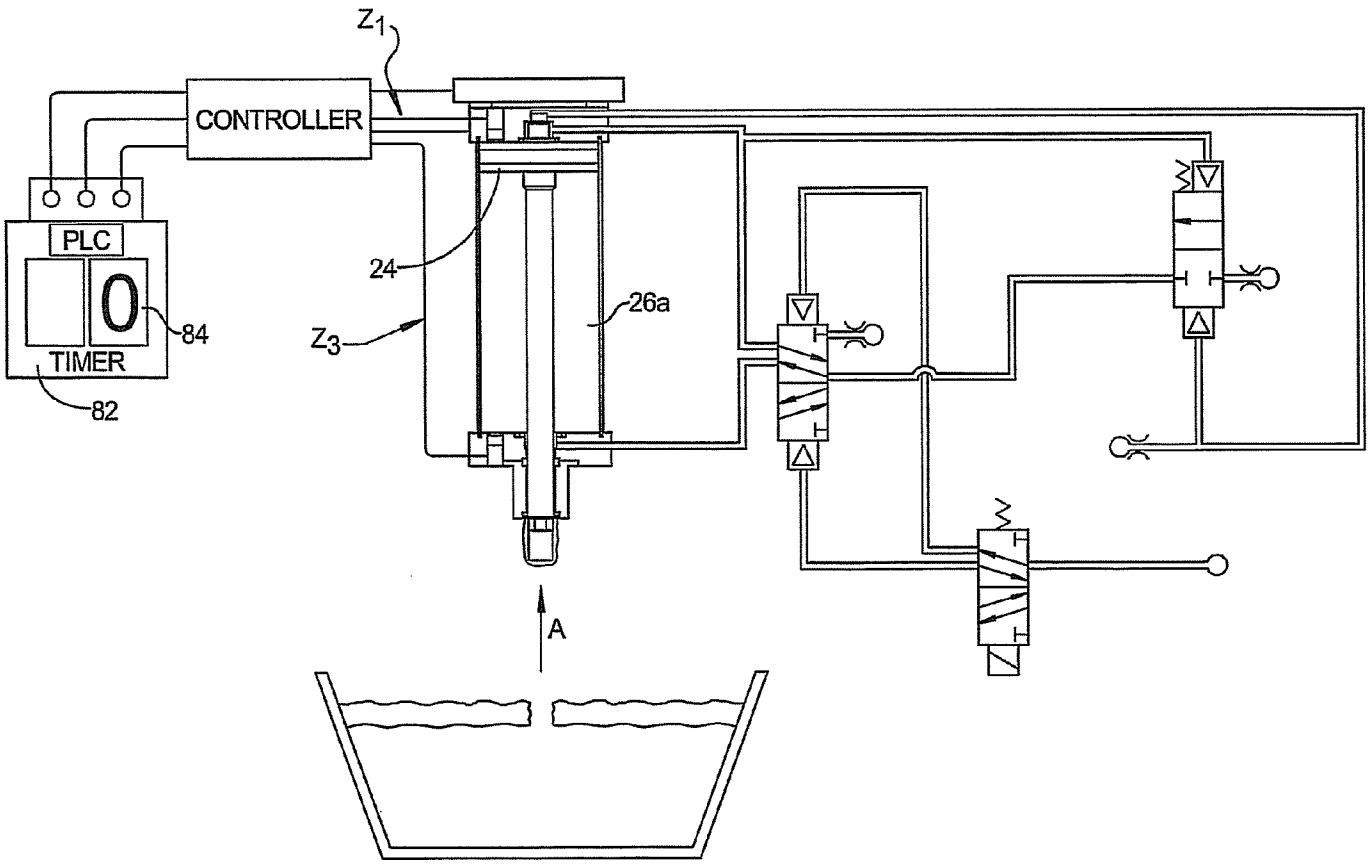
FIG. 9 is a diagram modified from FIG. 8 to show completion of the crust breaker and bath detection system operation following the no bath detection condition.

Referring to FIG. 9, and again to FIG. 6, operation of bath detection system 10 is substantially the same following closure of third circuit $Z_3$ as operation following a bath detection sequence. Piston 24 is displaced in the piston return direction "A" until the piston first stop position is reached. At the piston first contact position piston 24 contacts biasing member 80 of first electrical contact device 72, closing first electrical circuit $Z_1$. Timer 82 continues to count down until indicator symbol 84 reaches zero, at which time a relatively small amount of air pressure (as one example, approximately 8 psi) is trapped in first portion 26*a* of piston chamber 26 to hold piston 24 at the piston first stop position.

Figure 10:
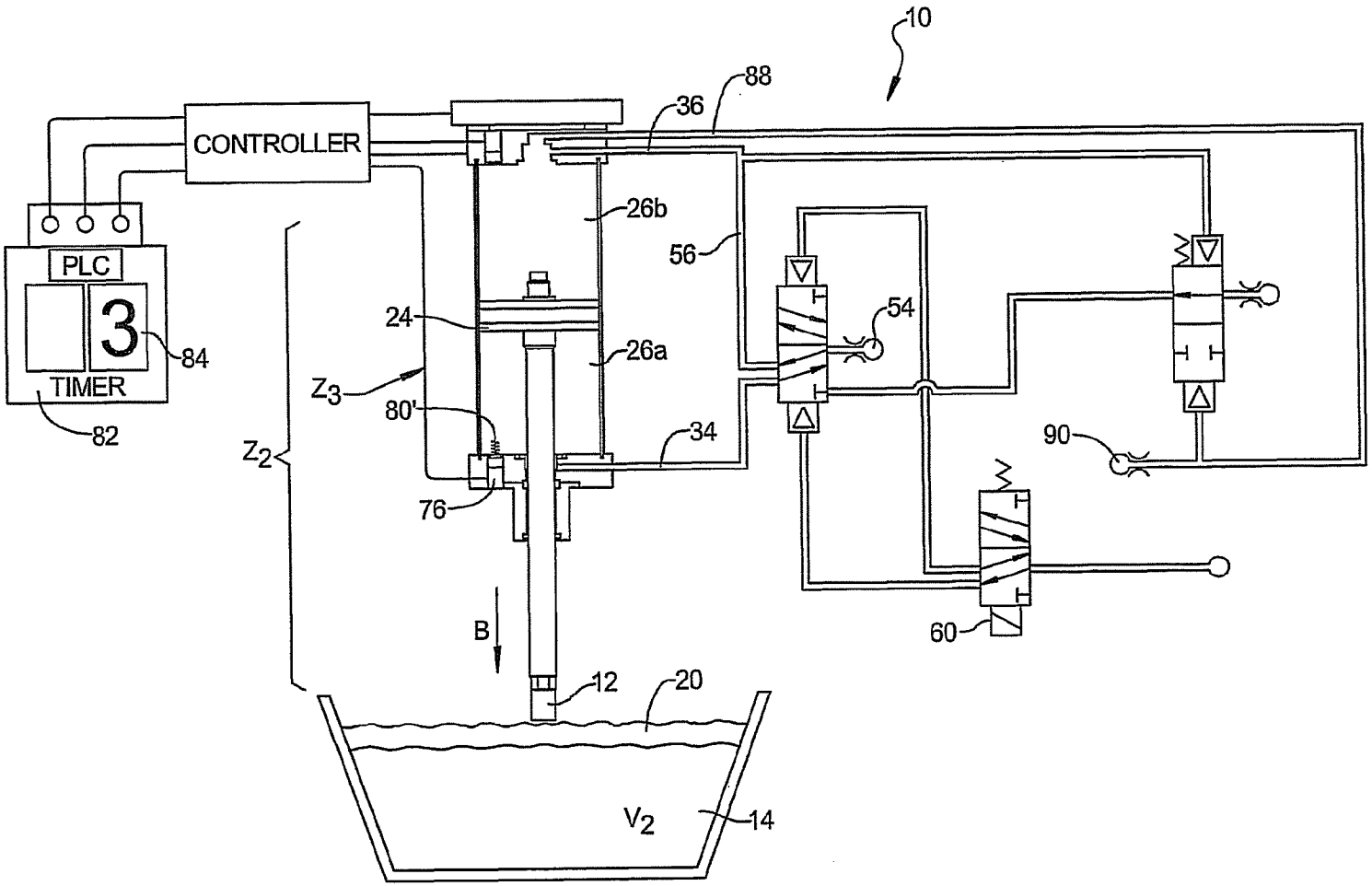
FIG. 10 is a diagram modified from FIG. 4 to show a hard crust condition.

Referring to FIG. 10 and again to FIGS. 1 and 4, bath detection system 10 is further configured to identify a hard crust condition, defined as the crust breaker rod 12 being unable to penetrate crust layer 20. When a hard crust condition is encountered, bath detection second circuit $Z_2$ cannot close because crust breaker rod 12 does not enter and detect the voltage $V_2$ of melt bath 14. Third circuit $Z_3$ also cannot close because piston 24 does not contact biasing member 80' of second electrical contact device 76. Pressure in second portion 26*b* of piston chamber 26 will therefore increase to the maximum pressure of third pressure source 54 via air delivery/vent line 56 and second air supply/vent line 36, and/or from fourth pressure source 90 via pressure transfer line 88. In the example provided, approximately 1 second has elapsed to this point in the cycle, and indicator symbol 84 indicates approximately 3 seconds remain in the cycle governed by timer 82.

Figure 11:
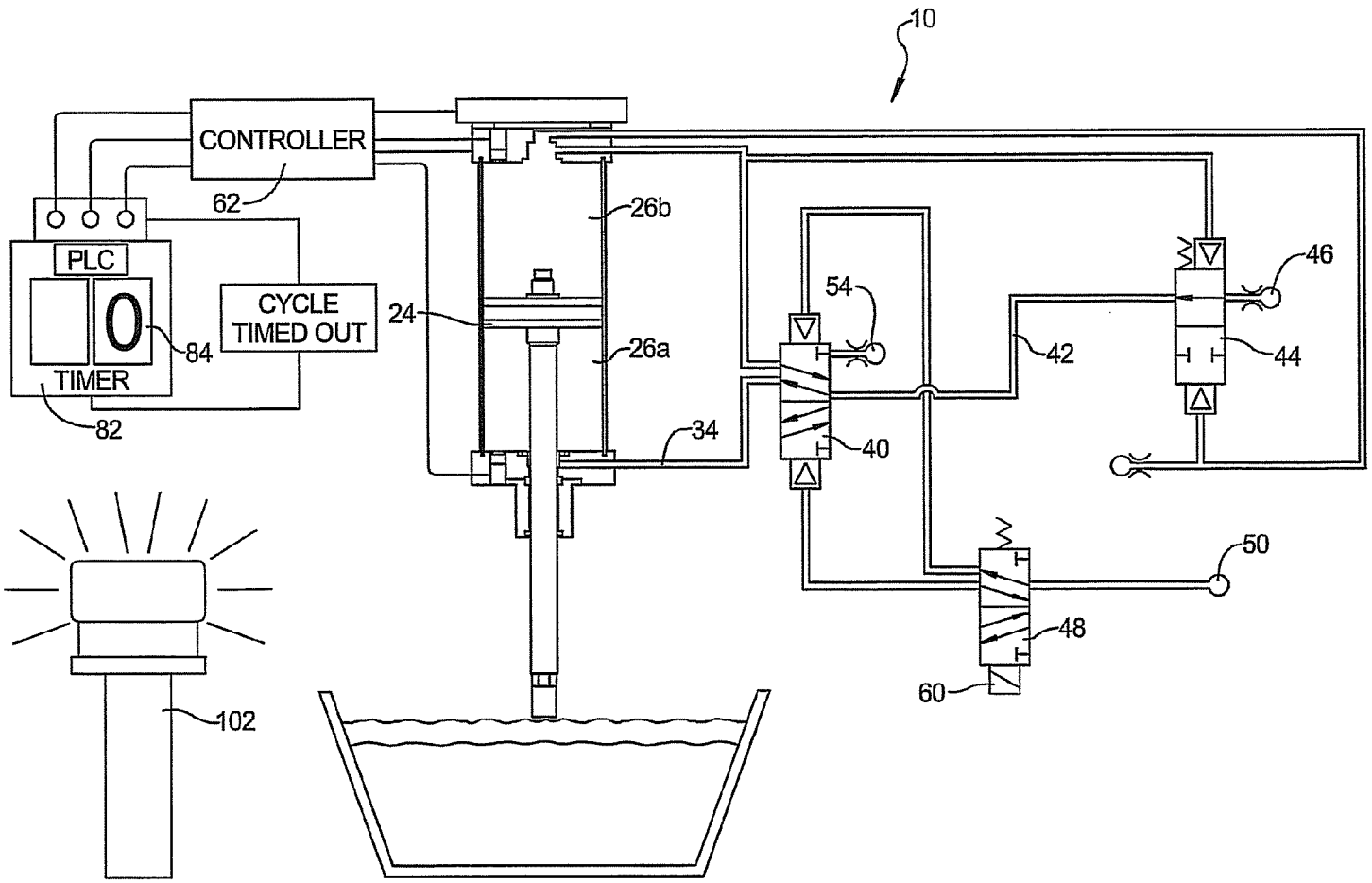
FIG. 11 is a diagram modified from FIG. 10 to show realignment of system control valves to alert occurrence of the hard crust condition.

Referring to FIG. 11, if the maximum pressure of third pressure source 54 and/or from fourth pressure source 90 does not permit crust breaker rod 14 to penetrate crust layer 20, timer 82 continues to count down until indicator symbol 84 reaches zero, at which time because no circuit has closed indicating that either a bath detection has occurred or that no bath detection has occurred, controller 62 directs solenoid 60 to de-energize. First control valve 40 is repositioned as previously described using pressurized air from second pressure source 50 such that third pressure source 54 is once again no longer in communication with second portion 26*b* of piston chamber 26. First pressure source 46 is once again aligned with first portion 26*a* and the air pressure in first portion 26*a* increases to, for example, approximately 25 psi force-venting second portion 26*b*, and piston 24 begins to move in the piston return direction "A". An operator alert device 102 is triggered on by controller 62 to visually and/or audibly warn the system operator that the crust layer 20 was not broken and therefore no additional feed of alumina material occurred to melt bath 14.

Figure 12:
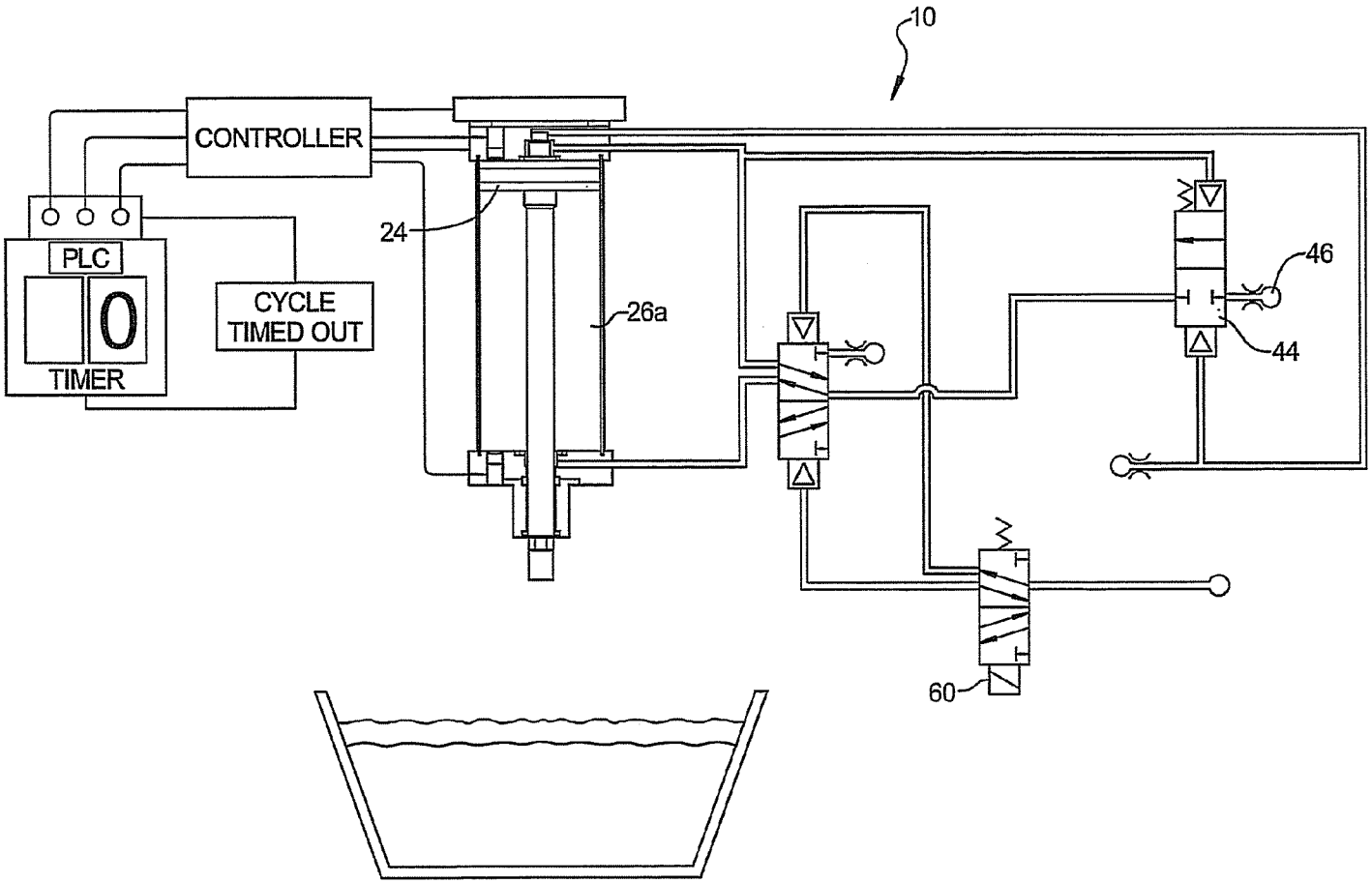
FIG. 12 is a diagram modified from FIG. 11 to show completion of the crust breaker and bath detection system operation following the hard crust condition.

Referring to FIG. 12 and again to FIG. 11 for the example or embodiment provided, when piston 24 returns to the piston first contact position with solenoid 60 de-energized, the air pressure in first portion 26*a* is approximately 25 psi. Second control valve 44 is also repositioned to isolate pressurized air in first pressure source 46 from first portion 26*a*.

Figure 13:
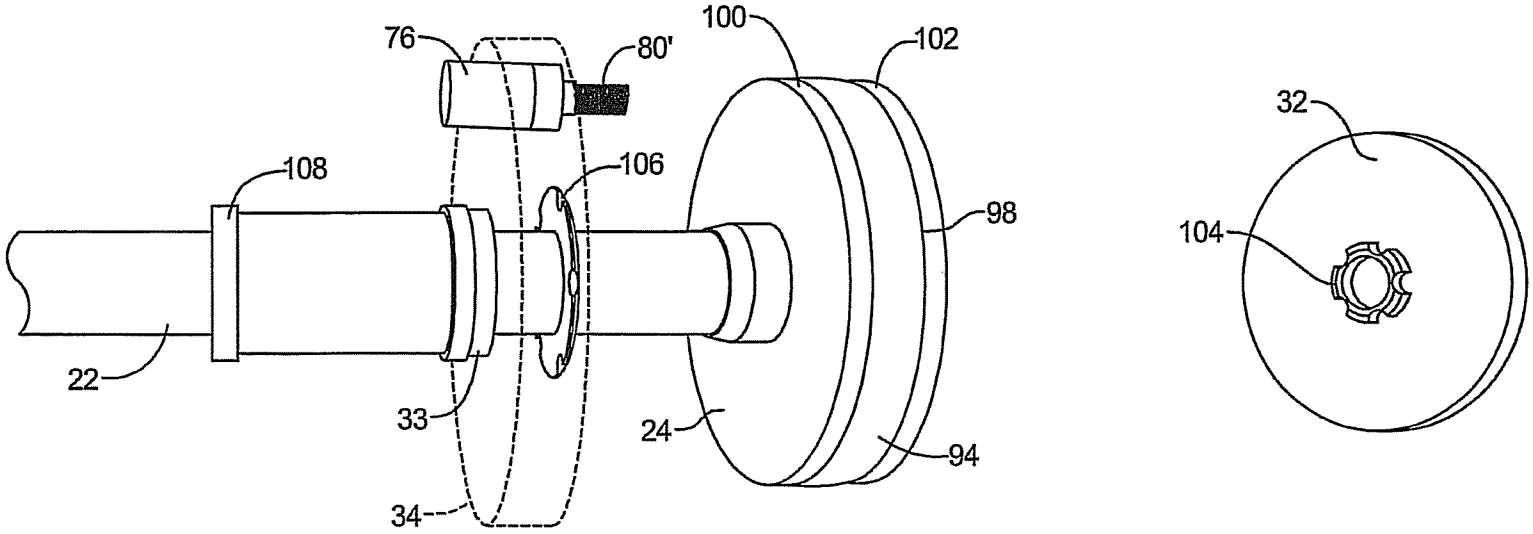
FIG. 13 is a cross sectional side elevational view of the piston and cylinder arrangement for the bath detection system of the present disclosure.

Referring to FIG. 13, in addition to electrically conductive piston seal 94 which can be positioned in a slot 98, piston 24 can further include at least one and according to several embodiments first and second seal rings 100, 102. A first cushion seal 104 can be provided with first cylinder head 32, and a second cushion seal 106 can be provided with second cylinder head 34, thereby providing first and second cushion seals 104, 106 at opposite ends of piston chamber 28 to assist with creation of pressure seals at the piston first and second stop positions. First and second cushion seals 104, 106 as known in the art can be of the directional-open type to assist in cylinder venting. A scraper 108 can also be provided which physically scrapes off a portion of the crust layer, aluminum melt bath material, or other material that creates coating material 96 shown and described in reference to FIG. 7.

According to several embodiments, crust breaker aluminum bath detection system 10 includes conductive cylinder 28 defining piston chamber 26. Conductive piston 24 is slidably displaced within the cylinder 28 by a pressurized fluid directed to either a first portion 26*a* of the piston chamber 26 with respect to the piston 24 or a second portion 26*b* of the piston chamber 26 oppositely positioned about the piston 24 with respect to the first portion 26*a*. Means for crust breaking (crust breaker rod 12 and/or piston rod 22) is connected to the piston 24 and displaced into melt bath 14 when the piston 24 is displaced in the cylinder 28 in piston drive direction "B".

Means for conducting a voltage (piston seal 94) is retained by and in conductive contact with the piston 24 and in slidable and conductive contact with the cylinder 28 at any position of the piston 24 within the cylinder 28.

Figure 14:
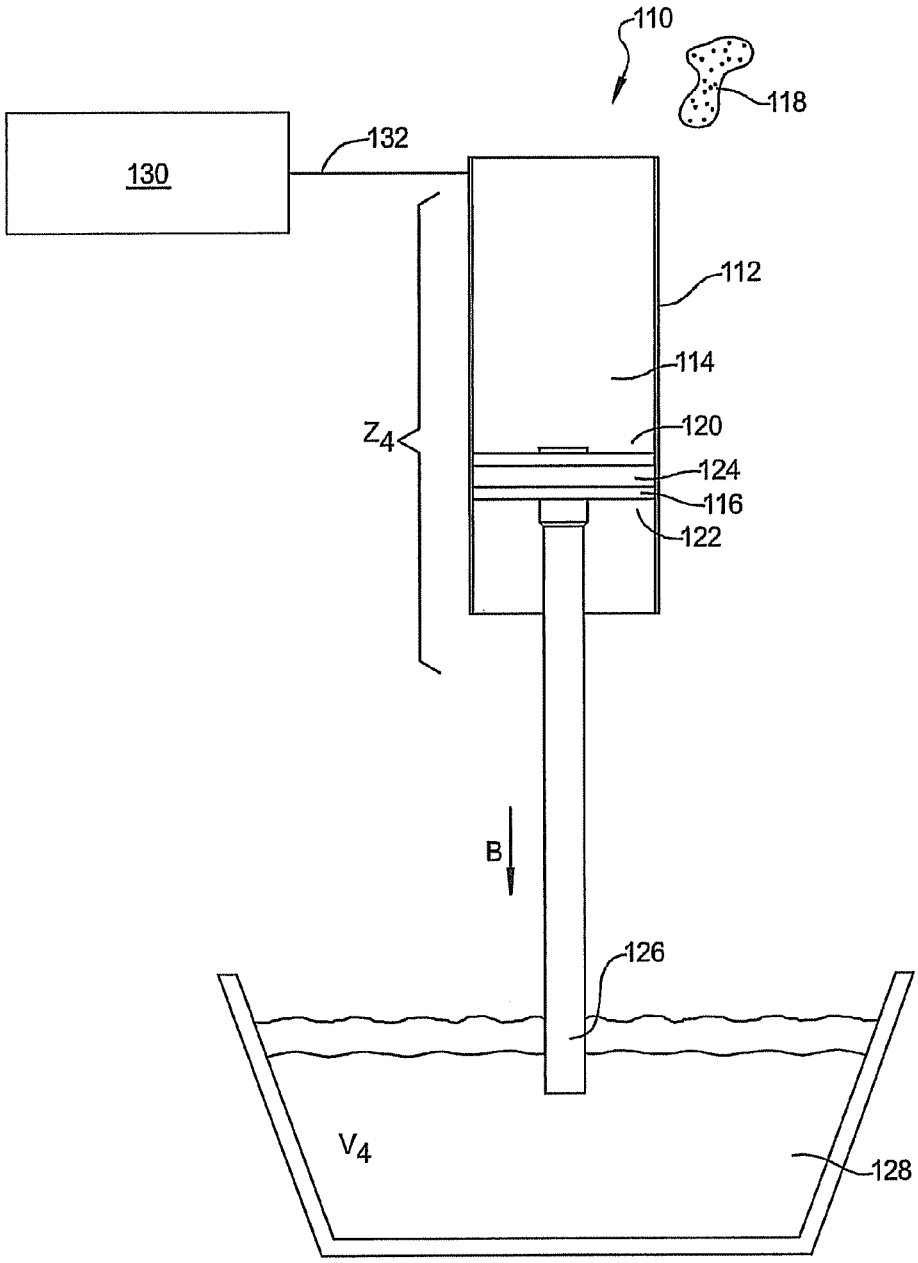
FIG. 14 is a front elevational view of a piston and cylinder electrical system of another embodiment of the present disclosure.

Referring to FIG. 14, according to further embodiments, a piston and cylinder electrical system 110 includes a conductive cylinder 112 defining a piston chamber 114. A conductive piston 116 is slidably displaced within the piston chamber 114 by a pressurized fluid 118 directed to either a first portion 120 of the piston chamber 114 with respect to the piston 116 or a second portion 122 of the piston chamber 114 oppositely positioned about the piston 116 with respect to the first portion 120. A conductive member 124 is retained by and in electrical contact with the piston 116 and in slidable and electrical contact with the cylinder 112 at any position of the piston 116 within the piston chamber 114. The conductive member 124 defines a portion of an electrical circuit $Z_4$ including the piston 116, the conductive member 124 and the cylinder 112. The piston and cylinder electrical system 110 can further include a conductive piston rod 126 connected to the piston 116 which can be displaced into a bath 128 having a bath voltage $V_4$ when the piston 116 is displaced in the cylinder 112 in the piston drive direction "B". The bath voltage $V_4$ is conducted through the piston rod 126 to the piston 116 and the electrical circuit $Z_4$. Piston and cylinder electrical system 110 can further include a control device 130 connected to the cylinder 112 by a voltage line 132, the voltage line 132 and the control device 130 forming an additional portion of the circuit $Z_4$.

Figure 15:
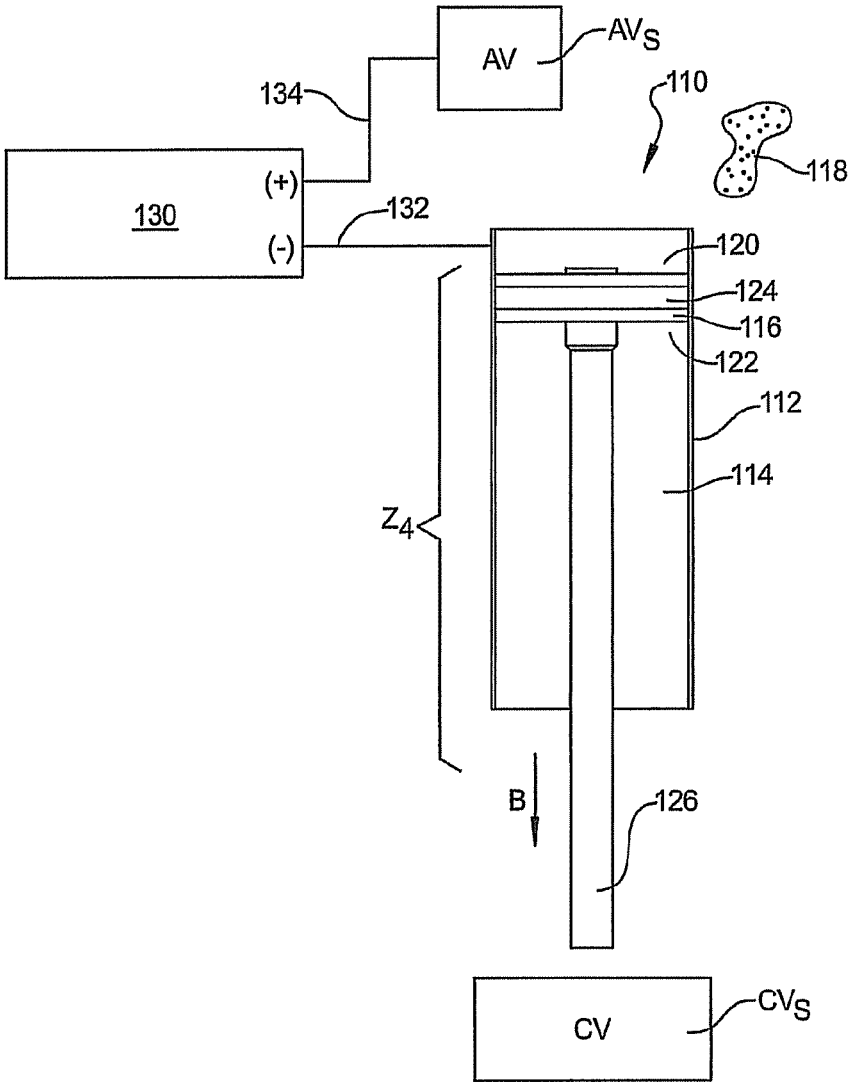
FIG. 15 is a front elevational view a piston and cylinder electrical system of a further embodiment of the present disclosure.

Referring to FIG. 15, according to further embodiments, the piston and cylinder electrical system 110 can further include conductive piston rod 126 connected to the piston 116 and displaced into contact with a cathode voltage source CVs when the piston 116 is displaced in the cylinder 112 in the piston drive direction "B". A cathode voltage CV of the cathode voltage source CVs is conducted by the piston rod 126 to the piston 116 and by voltage line 132 of the electrical circuit $Z_4$. An anode voltage source AVs having an anode voltage AV can also be connected to control device 130 by a second voltage line 134 to help complete fourth circuit $Z_4$.

Figure 16:
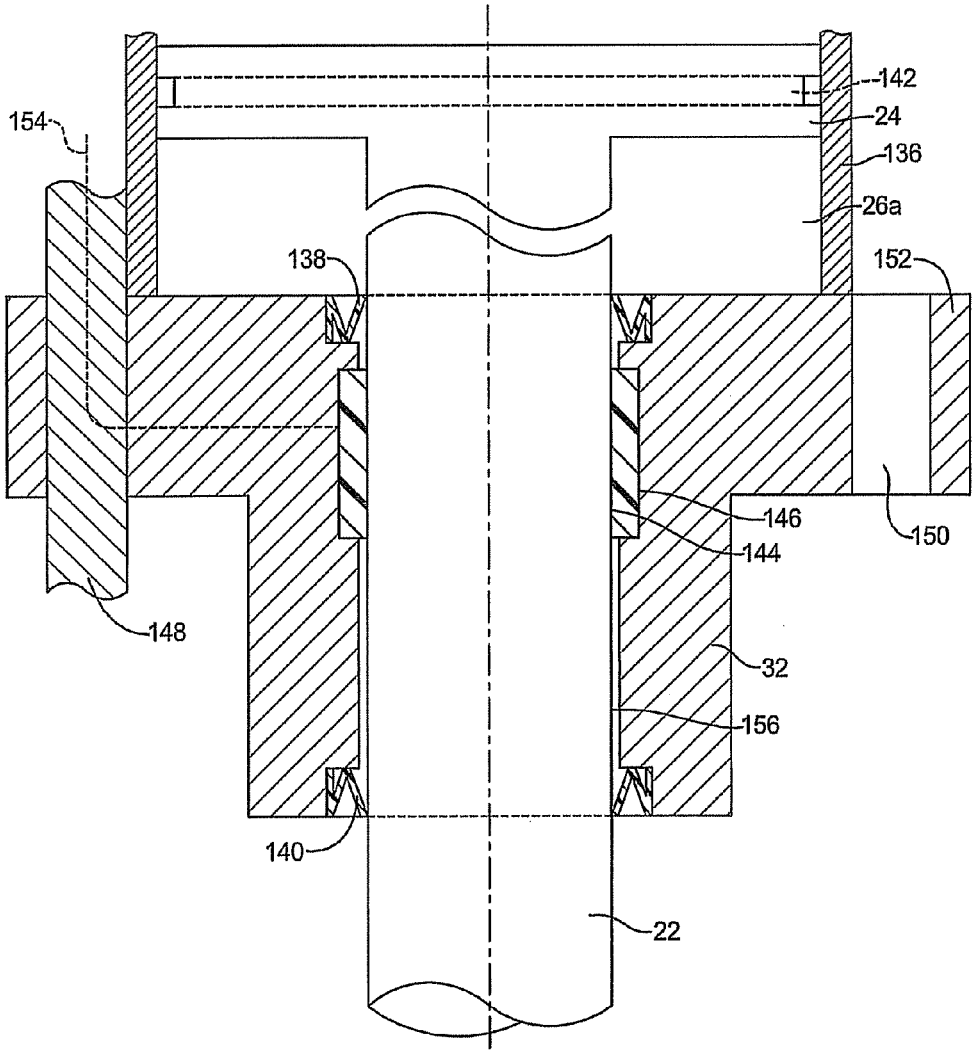
FIG. 16 is a cross sectional front elevational view at area 16 of FIG. 4.

Referring to FIG. 16, for those systems having a non-conductive cylinder 136 in place of conductive cylinder 28, non-conductive cylinder 136 will be ineffective in forming a portion of a conductive circuit acting as an aluminum bath detection circuit. This can occur when cylinder 136 has a non-conductive corrosion resistant coating, and/or where the material of the cylinder 136 may be non-conductive. Such a system may include flexible and non-conductive materials as a non-conductive seal 138, a non-conductive wiper 140, and a non-conductive element in the position of a wear band or seal 142 of the piston 24. The use of a conductive element in the position of wear band or seal 142 of the piston 24 will be ineffective in forming a portion of a conductive circuit acting as an aluminum bath detection circuit. Non-conductive seal 138 and non-conductive wiper 140 are in direct contact with an outer surface 144 of piston rod 22.

In these systems, a conductive material wear band/seal 146 in second cylinder head 32 can be used in place of a commonly used non-conductive seal in this position. Conductive material wear band/seal 146 provides direct contact with outer surface 144 of piston rod 22, and therefore will conduct a current from outer surface 144 of piston rod 22 via conductive material wear band/seal 146 to second cylinder head 32, and further to one or more conductive material tie rods 148 which mechanically connect the first and second cylinder heads 30, 32 at opposite ends of the non-conductive cylinder 136. Tie rods 148 are received in clearance bores 150 created at least through a flange 152 of second cylinder head 32. Tie rods 148 therefore electrically bypass non-conductive cylinder 136. A portion of a conductive circuit 154 used in an aluminum bath detection circuit of the present disclosure therefore includes piston rod 22, conductive material wear band/seal 146, second cylinder head 32 and tie rod 148. The conductive material wear band/seal 146 is sized to extend across and entirely through a clearance gap 156 (shown in exaggerated size) provided for rotational clearance of piston rod 22.

Referring again to FIG. 1, according to further embodiments, bath detection system 10 can be modified to replace conductive seal 94 with a non-conductive material, and to replace a non-conductive material bearing/seal 33 with a conductive material. This will modify at least the second and third circuits $Z_2$, $Z_3$, because cylinder 28 may be non-conductive or have an anodized coating rendering cylinder 28 non-conductive. Alternate paths for electrical conduction can then include structural members (not shown) such as conductive tie rods known in the art used to conductively join the first and second cylinder heads 30, 32, and/or conductive bearing flanges used to retain conductive bearing/seal 33. In these embodiments, bath voltage can be carried from crust breaker rod 12, to piston rod 22, conductive bearing/seal 33, second cylinder head 32, the one or more tie rods, first cylinder head 30 and second voltage line 70 to controller 62. Third circuit $Z_3$ would therefore include second signal line 78, second electrical contact device 76, conductive biasing member 80', piston 24, piston rod 22, conductive bearing/seal 33, second cylinder head 32, the one or more tie rods, first cylinder head 30 and second voltage line 70 to controller 62.

Baths such as aluminum melt baths commonly include a voltage profile which can vary from one voltage at the upper or crust layer to a different and typically higher voltage at the bottom of the bath. As one example, such voltage can vary from approximately zero (0) volts at the upper layer to approximately 4.0 volts at the bottom of the bath. Bath detection systems of the present disclosure can be pre-set to activate and/or de-activate pneumatic control valves based on a predetermined bath voltage detected when crust breaker rod 12 enters and extends to a depth of bath 14. An example voltage of 0.3 volts used herein can be varied at the discretion of the system designer and the control equipment used. Melt baths such as aluminum melt baths are also commonly electrically aligned in series from cathode to anode. The overall system voltage and current, as well as timer sequences and pressures recited, can therefore vary based on a quantity of baths in the system and/or on the particular aluminum processing facility or country in which it is located.

According to several embodiments, exemplary control and solenoid operated valves of the present disclosure can be manufactured by Mac Valves, Inc., of Wixom, Mich. First control valve 38 can be a Mac Valves No. 6622 valve. Second control valve 44 can be a Mac Valves No. 53 valve. Solenoid operated valve 54 can be a Mac Valves No. 45 valve.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A bath detection system, comprising:

an electrically conductive cylinder defining a piston chamber;

an electrically conductive piston slidably displaced within the piston chamber by a pressurized fluid directed to either a first portion of the piston chamber with respect to the piston or a second portion of the piston chamber oppositely positioned about the piston with respect to the first portion;

an electrically conductive piston rod connected to the piston and displaced into a bath having an electrical potential when the piston is displaced in the cylinder in a piston drive direction;

an electrically conductive member in electrical contact with the piston and thereby during sliding motion of the piston in slidable and electrical contact with the cylinder at all positions of the piston within the cylinder a bath detection electrical circuit including the piston rod, the piston, the conductive member and the cylinder, wherein the bath detection electrical circuit is closed when the crust breaker rod contacts the bath; and a timer in communication with a controller, the timer providing a selectable cycle time for displacement of the piston from a piston first contact position, a displaced position of the piston with the piston rod in contact with the bath, and return of the piston to the piston first contact position.

2. The bath detection system of claim 1, wherein the controller is in electrical communication with the cylinder and defines a further portion of the electrical circuit, the bath voltage being conducted to the controller by the bath detection circuit via an electrical path including the piston rod, the piston, the electrically conductive member and the cylinder when the bath detection circuit is closed.

3. The bath detection system of claim 1, wherein the cylinder includes a first cylinder head and an opposed second cylinder head, the piston at the piston first contact position in direct contact with the first cylinder head.

4. The bath detection system of claim 2, further including:

a first cylinder head connected to the cylinder; and a first electrical contact device received in the first cylinder head having a conductive biasing member extending into the piston chamber, the conducting biasing member directly contacting the first cylinder head in a piston first stop position and not in contact with the piston when the piston moves away from the piston first stop position.

5. The bath detection system of claim 4, further including a first electrical contact device circuit having a path including the controller, a voltage line connecting the controller to the first cylinder head, the cylinder, the conductive member, the piston and a signal line connecting the first electrical contact device to the controller, the first electrical contact device circuit closed when the conductive biasing member of the first electrical contact device is directly contacted by the piston generating a confirmation signal in the controller that the piston is positioned proximate to the first cylinder head defining a piston first stop position.

6. The bath detection system of claim 2, further including:

first and second cylinder heads connected to the cylinder;

a first electrical contact device received in the first cylinder head; and a second electrical contact device received in the second cylinder head having a conductive biasing member extending into the piston chamber.

7. The bath detection system of claim 6, further including an electrical contact device circuit having a path including the controller, a voltage line connecting the controller to the first cylinder head, the cylinder, the conductive member, the piston and a signal line connecting the second electrical contact device to the controller, the electrical contact device circuit closed when the conductive biasing member of the second electrical contact device is directly contacted by the piston generating a confirmation signal in the controller that the piston is positioned proximate to the second cylinder head defining a piston second stop position.

8. The bath detection system of claim 1, further including:

a bath voltage generated by the bath, the bath being an aluminum melt bath, the bath voltage when identified in the controller acting to create a bath detection voltage;

a solenoid of a solenoid operated valve energized when the bath detection voltage is created to reposition the solenoid operated valve; and a control valve repositioned when the solenoid operated valve is repositioned, the control valve directing pressurized air to the first portion of the piston chamber to move the piston in a piston return direction.

9. The bath detection system of claim 1, wherein the conductive member is a wear band including an electrically conductive material received in a slot of the piston.

10. A crust breaker bath detection system, comprising:

a cylinder defining a piston chamber;

a piston slidably displaced within the piston chamber by a pressurized fluid;

a crust breaker rod connected to the piston and displaced through a non-conductive crust layer into a bath having a bath voltage when the piston is displaced in the cylinder in a piston drive direction;

a first cylinder head connected to the cylinder;

a first electrical contact device received in the first cylinder head having a conductive biasing member extending into the piston chamber, the conducting biasing member directly contacting the first cylinder head in a piston first stop position and not in contact with the piston when the piston moves away from the piston first stop position;

a controller in electrical communication with the cylinder; and a conductive member retained by and in electrical contact with the piston and in continuous and conductive contact with the cylinder at all positions of the piston within the piston chamber a bath detection electrical circuit including the crust breaker rod, the piston, the conductive member, the cylinder and the controller, the bath detection circuit conducting the bath voltage through the crust breaker rod, the piston, the conductive member and the cylinder to the controller when the crust breaker rod contacts the bath such that the bath voltage is communicated to the controller by the bath detection circuit.

11. The crust breaker bath detection system of claim 10, further including first, second and third pressure sources of the pressurized fluid.

12. The crust breaker bath detection system of claim 11, wherein the piston in the cylinder defines a first portion of the piston chamber with respect to the piston and a second portion of the piston chamber oppositely positioned about the piston with respect to the first portion, wherein the pressurized fluid is directed to either the first portion to move the piston in a piston return direction or to the second portion to move the piston in the piston drive direction opposite to the piston return direction.

13. The crust breaker bath detection system of claim 12, further including:

a solenoid valve having a solenoid; and a control valve positioned by pressurized air directed to the control valve from the second pressure source by the solenoid valve;

wherein the controller de-energizes the solenoid of the solenoid operated valve thereby repositioning the control valve to direct the pressurized fluid received from the first pressure source to the first portion of the piston chamber to move the piston in a piston return direction.

14. The crust breaker bath detection system of claim 12, further including:

a solenoid valve having a solenoid; and a control valve positioned by pressurized air directed to the control valve from the second pressure source by the solenoid valve;

wherein the controller energizes the solenoid of the solenoid operated valve thereby repositioning the control valve to direct the pressurized fluid received from the third pressure source to the second portion of the piston chamber to move the piston in a piston return direction.

15. The crust breaker bath detection system of claim 10, further including a control voltage generated by the controller, the bath voltage when added to the control voltage in the controller creating a third voltage used by the controller to de-energize a solenoid of a solenoid operated valve.

16. The crust breaker bath detection system of claim 15, further including a pneumatic control system connected to at least one source of the pressurized fluid, the third voltage used by the controller to signal operation of the pneumatic control system thereby directing flow from the at least one source.

17. The crust breaker bath detection system of claim 10, further including:

a timer in electrical communication with the controller operating to set a total time period for completion of a crust breaking operation; and a signal generated by the timer timing out the crust breaking operation at an end of the total time period if the bath detection circuit does not close.

18. A crust breaker aluminum bath detection system, comprising:

a conductive cylinder defining a piston chamber;

a conductive piston slidably displaced within the cylinder by a pressurized fluid directed to either a first portion of the piston chamber with respect to the piston or a second portion of the piston chamber oppositely positioned about the piston with respect to the first portion;

means for crust breaking conductively connected to the piston and displaced into an aluminum melt bath when the piston is displaced in the cylinder in a piston drive direction;

timing means in communication with a controller, the timing means providing a selectable cycle time for displacement of the piston from a piston first contact position, a displaced position of the piston with the piston rod in contact with the bath, and return of the piston to the piston first contact position; and means for conducting a voltage through the means for crustbreaking to the conductive cylinder is retained by and in conductive contact with the piston and in conductive contact with the cylinder such that a voltage of the aluminum melt bath is conducted to the conductive cylinder when the means for crustbreaking contacts the aluminum melt bath.

19. The crust breaker aluminum bath detection system of claim 18, wherein the conducting means defines a portion of a bath detection circuit including the crust breaking means, the piston, the conducting means and the cylinder, the bath detection circuit closed when the crust breaking means contacts the aluminum melt bath.

20. The crust breaker aluminum bath detection system of claim 18, wherein the conducting means comprises a conductive seal member retained by the piston, the conductive seal member creating a pressure boundary between the piston and the cylinder.

21. The crust breaker aluminum bath detection system of claim 18, wherein the crust breaking means comprises a conductive crust breaker rod connected to a conductive piston rod, the piston rod connected to the piston.

22. A bath detection system, comprising:

a cylinder defining a piston chamber;

a cylinder head connected to the cylinder and defininiq a lower end of the piston chamber;

a piston slidably displaced within the piston chamber by a pressurized fluid directed to either a first portion of the piston chamber with respect to the piston or a second portion of the piston chamber oppositely positioned about the piston with respect to the first portion;

a piston rod connected to the piston and extending through the cylinder head, the piston rod having a crust breaker rod portion displaced into a bath having a bath voltage when the piston is displaced in the cylinder in a piston drive direction; and a conductive material wear band fixed to the cylinder head and in slidable and electrical contact with the piston rod, the conductive material wear band together with the piston rod defining a portion of a bath detection circuit, the bath detection circuit being closed and conducting the bath voltage from the bath through the piston rod, the conductive material wear band, and the piston to the cylinder when the crust breaker rod contacts the bath.

23. The bath detection system of claim 22, further including first and second cylinder heads located at opposite ends of the cylinder, the piston rod extending out of the piston chamber through the second cylinder head.

24. The bath detection system of claim 23, further including at least one tie rod connecting the first and second cylinder heads, the at least one tie rod being electrically conductive and forming a portion of the bath detection circuit.

25. The bath detection system of claim 23, wherein the conductive member defines a seal received in the second cylinder head, at least the second cylinder head being conductive, the bath detection circuit further including the second cylinder head.

26. The bath detection system of claim 22, wherein the cylinder is non-conductive.

27. A piston and cylinder electrical system, comprising:

a conductive cylinder defining a piston chamber;

a conductive piston slidably displaced within the piston chamber by a pressurized fluid directed to either a first portion of the piston chamber with respect to the piston or a second portion of the piston chamber oppositely positioned about the piston with respect to the first portion, the piston having a circumferential slot;

a conductive member fixed in the slot of the piston and in electrical contact with the piston and in slidable and electrical contact with the cylinder a circuit including the piston, the conductive member and the cylinder; and a conductive piston rod conductively connected to the piston and displaced into a bath having a bath voltage when the piston is displaced in the cylinder in a piston drive direction, the bath voltage conducted through the piston rod through the conductive member, and through the piston to the conductive cylinder.

28. The piston and cylinder electrical system of claim 27, further including a control device connected to the cylinder by a voltage line, the voltage line and the control device forming an additional portion of the circuit.

* * * * *

UNITED STATES PATENT AND TRADEMARK OFFICE

CERTIFICATE OF CORRECTION

PATENT NO. : 8,932,515 B2
APPLICATION NO. : 13/158933
DATED : January 13, 2015
INVENTOR(S) : Gilles Beaulieu It is certified that error appears in the above-identified patent and that said Letters Patent is hereby corrected as shown below:

ON THE TITLE PAGE

Item (73) Assignee: "La-Z-Boy, Incorporated, Monroe, MI" should be changed to --MAC Valves, Inc., Wixom, MI--.

Signed and Sealed this
First Day of December, 2015

Michelle K. Lee

Michelle K. Lee
*Director of the United States Patent and Trademark Office*